US009708861B2

(12) United States Patent
Reddy et al.

(10) Patent No.: US 9,708,861 B2
(45) Date of Patent: Jul. 18, 2017

(54) SLINGSHOT SIDE SADDLE SUBSTRUCTURE

(71) Applicant: NABORS DRILLING USA, LP, Houston, TX (US)

(72) Inventors: Padira Reddy, Houston, TX (US); Ashish Gupta, Houston, TX (US)

(73) Assignee: NABORS DRILLING USA, LP, Houston, TX (US)

( * ) Notice: Subject to any disclaimer, the term of this patent is extended or adjusted under 35 U.S.C. 154(b) by 369 days.

(21) Appl. No.: 14/616,234

(22) Filed: Feb. 6, 2015

(65) Prior Publication Data

US 2015/0218891 A1 Aug. 6, 2015

Related U.S. Application Data

(63) Continuation-in-part of application No. 14/180,049, filed on Feb. 13, 2014.

(60) Provisional application No. 61/764,259, filed on Feb. 13, 2013.

(51) Int. Cl.
*E21B 7/02* (2006.01)
*E21B 15/00* (2006.01)

(52) U.S. Cl.
CPC ..... *E21B 15/003* (2013.01)

(58) Field of Classification Search
CPC . E21B 7/02; E21B 7/022; E21B 15/00; E21B 15/003; B66C 23/60
USPC ..... 175/162, 203, 206, 207; 52/116, 117, 52/118, 641.05
See application file for complete search history.

(56) References Cited

U.S. PATENT DOCUMENTS

| | | | | |
|---|---|---|---|---|
| 4,021,978 | A | 5/1977 | Busse et al. | |
| 4,117,941 | A | 10/1978 | McCleskey et al. | |
| 4,850,439 | A | 7/1989 | Lund | |
| 6,161,358 | A * | 12/2000 | Mochizuki | E21B 15/003 405/201 |
| 6,491,477 | B2 | 12/2002 | Bennett, Jr. et al. | |
| 6,962,030 | B2 * | 11/2005 | Conn | E21B 15/003 166/75.11 |
| 7,306,055 | B2 | 12/2007 | Barnes | |
| 7,308,953 | B2 | 12/2007 | Barnes | |
| 7,401,656 | B2 | 7/2008 | Wood et al. | |
| 7,628,229 | B2 | 12/2009 | Wood et al. | |
| 7,819,207 | B2 | 10/2010 | Cowan | |
| 8,516,751 | B2 | 8/2013 | Konduc et al. | |
| 8,661,743 | B2 | 3/2014 | Flusche | |
| 8,863,449 | B2 | 10/2014 | Donnally et al. | |
| 8,904,716 | B2 | 12/2014 | Donnally et al. | |
| 9,091,126 | B2 | 7/2015 | Thiessen et al. | |
| 9,132,871 | B2 | 9/2015 | Crisp et al. | |
| 9,140,080 | B2 | 9/2015 | Flusche | |
| 9,151,412 | B2 | 10/2015 | Trevithick et al. | |
| 9,163,462 | B2 | 10/2015 | Donnally et al. | |
| 9,249,626 | B2 | 2/2016 | Flusche | |
| 9,260,929 | B2 | 2/2016 | Mark | |

(Continued)

*Primary Examiner* — Kenneth L Thompson
(74) *Attorney, Agent, or Firm* — Adolph Locklar

(57) ABSTRACT

The drilling rig includes a first substructure and a second substructure. The second substructure is positioned generally parallel to and spaced apart from the first substructure and generally the same height as the first substructure. The drilling rig further includes a drill floor coupled to the first and second substructures, where the drill floor positioned substantially at the top of the first and second substructures.

8 Claims, 3 Drawing Sheets

(56) References Cited

U.S. PATENT DOCUMENTS

| | | | | |
|---|---|---|---|---|
| 9,267,328 | B2 | 2/2016 | Flusche | |
| 9,366,053 | B2 | 6/2016 | Thiessen et al. | |
| 9,382,766 | B2 | 7/2016 | Flusche | |
| 9,399,890 | B2 | 7/2016 | Mark | |
| 9,441,423 | B2 | 9/2016 | Donnally et al. | |
| 9,464,488 | B2 | 10/2016 | Thiessen | |
| 2003/0172599 | A1* | 9/2003 | Frink | E21B 15/003 52/116 |
| 2005/0126827 | A1 | 6/2005 | Berry | |
| 2014/0224543 | A1 | 8/2014 | Padira et al. | |
| 2015/0143759 | A1 | 5/2015 | Sparkman et al. | |
| 2016/0369570 | A1* | 12/2016 | Padira | E21B 15/003 |

* cited by examiner

SLINGSHOT SIDE SADDLE SUBSTRUCTURE

CROSS-REFERENCE TO RELATED APPLICATIONS

This application is a continuation in part which claims priority from U.S. application Ser. No. 14/180,049 filed Feb. 13, 2014, itself a non-provisional application which claims priority from U.S. provisional application No. 61/764,259 filed Feb. 13, 2013.

FIELD OF THE DISCLOSURE

The present disclosure relates generally to drilling rigs, and specifically to slingshot rig structures for land drilling in the petroleum exploration and production industry.

BACKGROUND OF THE DISCLOSURE

Land-based drilling rigs may be configured to be traveled from location to location to drill multiple wells within the same area known as a wellsite. In certain situations, it is necessary to travel across an already drilled well for which there is a well-head in place. Further, mast placement on land-drilling rigs may have an effect on drilling activity. For example, depending on mast placement on the drilling rig, an existing well-head may interfere with the location of land-situated equipment such as, for instance, existing well-heads, and may also interfere with raising and lowering of equipment needed for operations.

SUMMARY

The present disclosure provides for a land based drill rig. The land based drill rig may include a first and a second lower box, the lower boxes positioned generally parallel and spaced apart from each other. The land based drill rig may further include a drill floor. The drill floor may be coupled to the first lower box by a first strut, the first lower box and first strut defining a first substructure. The drill floor may also be coupled to the second lower box by a second strut, the second lower box and second strut defining a second substructure. The struts may be hingedly coupled to the drill floor and hingedly coupled to the corresponding lower box such that the drill floor may pivot between an upright and a lowered position. The drill floor may include a V-door oriented to generally face one of the substructures.

The present disclosure also provides for a land based drilling rig. The land based drilling rig may include a first and a second lower box, the lower boxes positioned generally parallel and spaced apart from each other. The land based drill rig may further include a drill floor. The drill floor may be coupled to the first lower box by a first strut, the first lower box and first strut defining a first substructure. The drill floor may also be coupled to the second lower box by a second strut, the second lower box and second strut defining a second substructure. The struts may be hingedly coupled to the drill floor and hingedly coupled to the corresponding lower box such that the drill floor may pivot between an upright and a lowered position. The drill floor may include a V-door oriented to generally face one of the substructures. The land based drilling rig may further include a mast coupled to the drill floor. The land based drilling rig may further include a tank support structure affixed to the first or second substructure. The tank support structure may include a tank and mud process equipment.

The land based drilling rig may further include a grasshopper positioned to carry cabling and lines to the drilling rig. The grasshopper may be positioned to couple to the drill floor generally at a side of the drill floor, and the side of the drill floor to which the grasshopper couples may face towards the first or second substructure

BRIEF DESCRIPTION OF THE DRAWINGS

The summary and the detailed description are further understood when read in conjunction with the appended drawings. For the purpose of illustrating the present disclosure, there are shown in the drawings exemplary embodiments of said disclosure; however, the disclosure is not limited to the specific methods, compositions, and devices disclosed. In addition, the drawings are not necessarily drawn to scale. In the drawings.

DETAILED DESCRIPTION

The present disclosure may be understood more readily by reference to the following detailed description, taken in connection with the accompanying figures, which form a part of this disclosure. It is to be understood that this disclosure is not limited to the specific devices, methods, applications, conditions or parameters described and/or shown herein, and that the terminology used herein is for the purpose of describing particular embodiments by way of example only and is not intended to be limiting of the present disclosure. Also, as used in the specification, including the appended claims, the singular forms "a," "an," and "the" include the plural, and reference to a particular numerical value includes at least that particular value, unless the context clearly dictates otherwise. The term "plurality," as used herein, means more than one.

Figure 1:
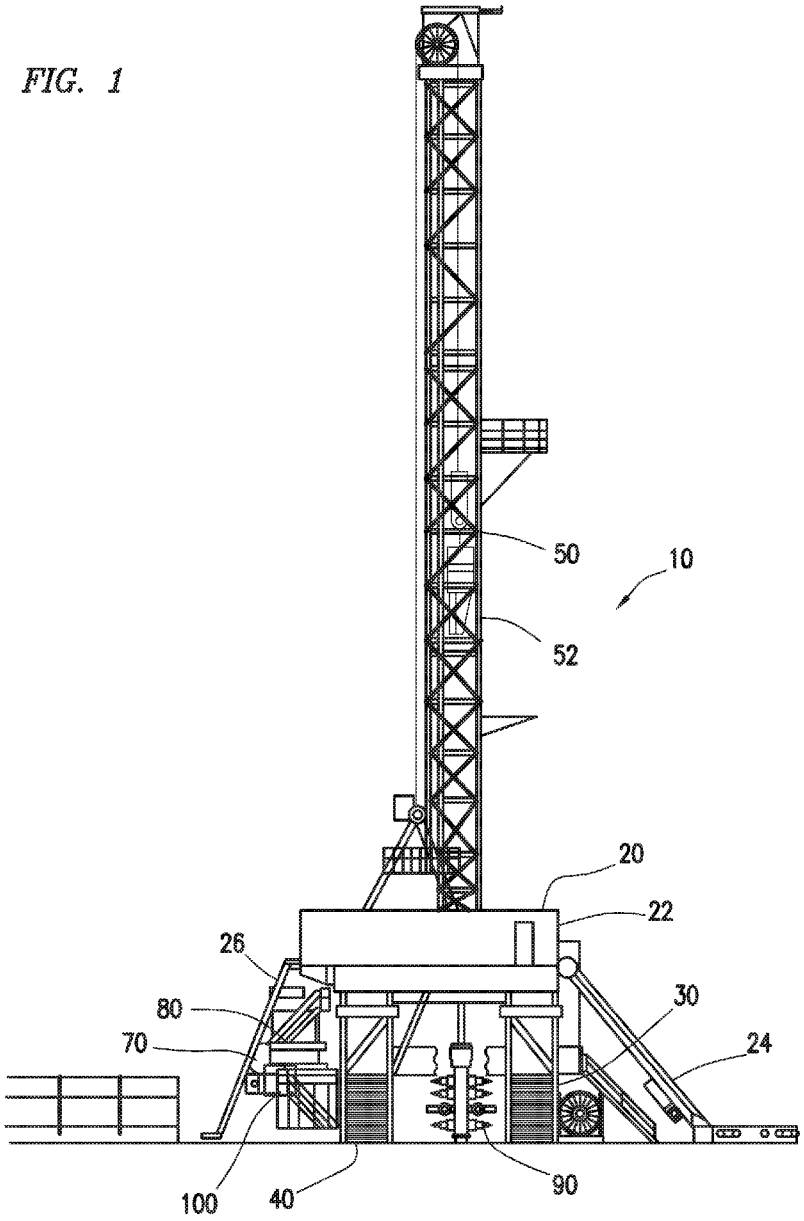
FIG. 1 is a side elevation from the driller's side of a drilling rig consistent with at least one embodiment of the present disclosure.

FIG. 1 depicts a side elevation of drilling rig 10 from the "driller's side" consistent with at least one embodiment of the present disclosure. Drilling rig 10 may include drill rig floor 20, right substructure 30, and left substructure 40. Right and left substructures 30, 40 may support drill rig floor 20. Mast 50 may be coupled to drill rig floor 20. As would be understood by one having ordinary skill in the art with the benefit of this disclosure, the terms "right" and "left" as used herein are used only to refer to each separate substructure to simplify discussion, and are not intended to limit this disclosure in any way. V-door side 22 of drilling rig 10 may be located over right substructure 30. The V-door side 52 of mast 50 may correspondingly face right substructure 30. Pipe handler 24 may be positioned to carry piping through a V-door as understood in the art positioned on V-door side 22 of drilling rig 10. In some embodiments, grasshopper 26 may be positioned to carry cabling and lines to drilling rig 10. In other embodiments (not shown), V-door side 22 and mast V-door side may face left substructure 40. In some embodiments, as depicted in FIG. 1, blow out preventer 90 may be located between left substructure 40 and right substructure 30, i.e. drilling rig 10 may be centered over a wellbore.

In some embodiments, tank support structure 80 and tanks 70 may be included in drilling rig 10. Tank support structure

80 may be affixed to right substructure 30 or left substructure 40 by means known to those of ordinary skill in the art with the benefit of this disclosure, including, but not limited to, welding and bolting. As shown in FIG. 1, tank support structure 80 may be affixed to left substructure 40. Tank support structure 80 may be located on the opposite substructure from V-door side 22 of drilling rig 10. Tanks 70 may, for example, be mud tanks, auxiliary mud tanks, or other tanks useful in drilling operations and may be located within tank support structure 80. In some embodiments, mud process equipment 100 may also be mounted within tank support structure 80. Mud process equipment may include, for example, shakers, filters, and other equipment associated with the use of drilling mud.

Figure 2:
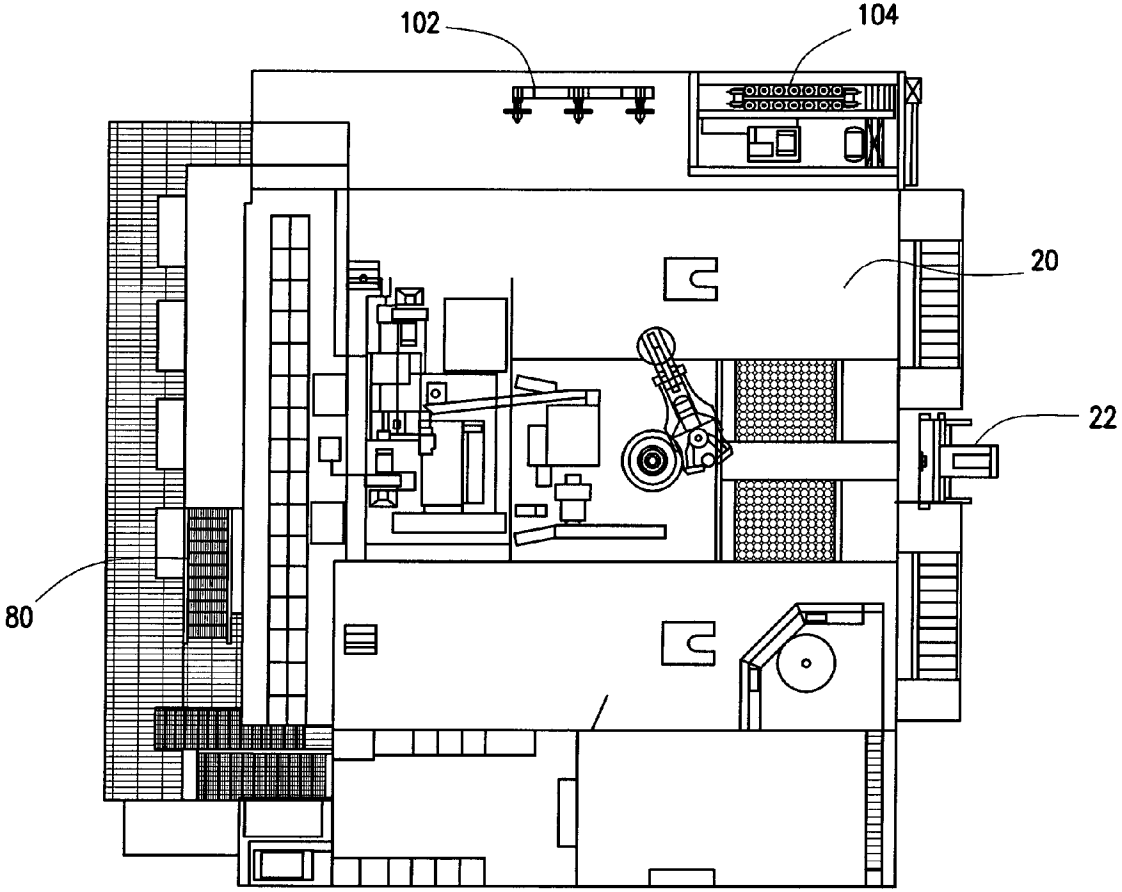
FIG. 2 is an overhead view of a drilling rig consistent with at least one embodiment of the present disclosure.

FIG. 2 depicts an overhead view of drilling rig 10 consistent with at least one embodiment of the present disclosure in which V-door side 22 of drilling rig 10, drilling rig floor 20, and tank support structure 80 are shown. In some embodiments, choke manifold 102 may likewise be located on the rig floor. In some embodiments, accumulator 104 may likewise be located on the rig floor. In some embodiments, accumulator 104 may be a Koomey Unit as understood in the art.

Figure 3:
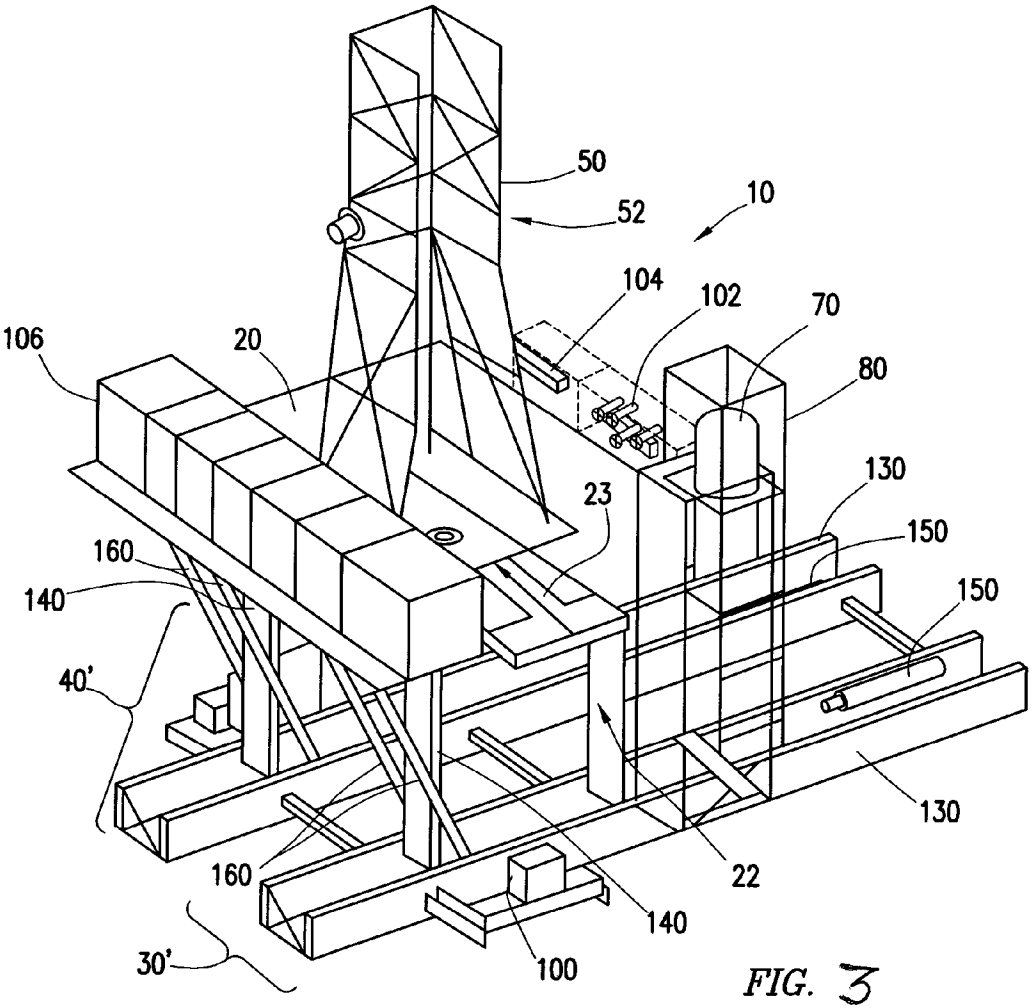
FIG. 3 is a perspective view of a drilling rig consistent with at least one embodiment of the present disclosure.

In some embodiments, substructures 30, 40 may be fixed as depicted in FIGS. 1, 2. In some embodiments, as depicted in FIG. 3, substructures 30', 40', may pivotably support drill rig floor 20. Drill rig floor 20 may be pivotably coupled to one or more lower boxes 130 by a plurality of struts 140 together forming substructures 131, 133. Lower boxes 130 may support drill rig floor 20. Lower boxes 130 may be generally parallel to each other and spaced apart. Struts 140 may be hingedly coupled to drill rig floor 20 and to lower boxes 130. In some embodiments, struts 140 may be coupled to lower boxes 130 and drill rig floor 20 such that they form a bar linkage therebetween, allowing relative motion of drill rig floor 20 relative to lower boxes 130 while maintaining drill rig floor 20 parallel to lower boxes 130. Thus, drill rig floor 20 may be moved from an upper position as shown in FIG. 3 to a lower position while remaining generally horizontal.

In some embodiments, the movement of drill rig floor 20 may be driven by one or more hydraulic cylinders 150. In some embodiments, when in the upright position, one or more diagonals 160 may be coupled between drill rig floor 20 and lower boxes 130 to, for example and without limitation, maintain drill rig floor 20 in the upright position.

In some embodiments, with reference to FIGS. 1-3, as they are mounted directly to a substructure (30 or 40) of drilling rig 10, one or more pieces of equipment may travel with drilling rig 10 during a skidding operation. For example and without limitation, equipment may include tanks 70, mud process equipment 100, choke manifold 102, accumulator 104, mud gas separators, process tanks, trip tanks, drill line spoolers, HPU's, VFD, or driller's cabin 106. As such any pipe or tubing connections between or taken from tanks 70, mud process equipment 100, choke manifold 102, and/or accumulator 104 may remain connected during the skidding operations. This arrangement may allow, for example, more rapid rig disassembly ("rigging-down") and assembly (or "rigging-up") of drilling rig 10 before and after a skidding operation.

Additionally, by facing V-door side 22 of drilling rig 10 toward one of the substructures 30, 40, equipment and structures that pass through the V-door 23 or to drilling floor 20 from V-door side 22 of drilling rig 10 may, for example, be less likely to interfere with additional wells in the well field.

One having ordinary skill in the art with the benefit of this disclosure will understand that the specific configuration depicted in FIGS. 1-3 may be varied without deviating from the scope of this disclosure.

Those skilled in the art will appreciate that numerous changes and modifications can be made to the preferred embodiments of the present disclosure and that such changes and modifications can be made without departing from the spirit of said disclosure. It is, therefore, intended that the appended claims cover all such equivalent variations as fall within the true spirit and scope of said disclosure.

What is claimed is:

1. A land based drilling rig comprising:

a first and second lower box, the lower boxes positioned generally parallel and spaced apart from each other;

a drill floor coupled to the first lower box by a first strut, the first lower box and first strut defining a first substructure, the drill floor coupled to the second lower box by a second strut, the second lower box and second strut defining a second substructure, the struts hingedly coupled to the drill floor and hingedly coupled to the corresponding lower box such that the drill floor may pivot between an upright and a lowered position, the drill floor including a V-door, the V-door oriented perpendicularly to a long axis of one of the substructures;

a mast coupled to the drill floor;

a tank support structure affixed to the first or second substructure, the tank support structure including:

a tank;

mud process equipment; and a grasshopper positioned to carry cabling and lines to the drilling rig, the grasshopper positioned to couple to the drill floor generally at a side of the drill floor, and the side of the drill floor to which the grasshopper couples is oriented perpendicular to a long axis of the first or second substructure.

2. The land based drilling rig of claim 1, wherein the mast further comprises a V-door side and wherein the V-door side of the mast faces the first or second substructure.

3. The land based drilling rig of claim 1, wherein the tank is a mud tank.

4. The land based drilling rig of claim 1 wherein the mud process equipment comprises at least one of a shaker or a filter.

5. The land based drilling rig of claim 1, wherein the first and second substructures are adapted to be traveled through a wellsite.

6. The land based drilling rig of claim 1, further comprising a choke manifold.

7. The land based drilling rig of claim 1, further comprising an accumulator.

8. The land based drilling rig of claim 1, further comprising one or more of a drill line spooler, an HPU, a VFD, a driller's cabin, hydraulic unit, trip tank, process tank, or mud gas separator.

* * * * *